US008529417B1

(12) United States Patent
Velasquez

(10) Patent No.: US 8,529,417 B1
(45) Date of Patent: Sep. 10, 2013

(54) PUSHUP EXERCISE DEVICE

(76) Inventor: Ricardo Velasquez, Denver, CO (US)

( * ) Notice: Subject to any disclaimer, the term of this patent is extended or adjusted under 35 U.S.C. 154(b) by 231 days.

(21) Appl. No.: 13/106,297

(22) Filed: May 12, 2011

(51) Int. Cl.
*A63B 71/00* (2006.01)
*A63B 21/068* (2006.01)
*A63B 23/16* (2006.01)

(52) U.S. Cl.
USPC ..... 482/141; 482/47; 482/95

(58) Field of Classification Search
USPC ..... 482/44, 47–49, 91–93, 95–96, 131, 482/141–142, 148; D21/662, 684, 686
See application file for complete search history.

(56) References Cited

U.S. PATENT DOCUMENTS

| | | | | |
|---|---|---|---|---|
| 5,226,868 | A | 7/1993 | Montgomery | |
| 7,063,646 | B1 * | 6/2006 | Slimi | 482/45 |
| 7,288,051 | B1 | 10/2007 | Phillips | |
| 2005/0148448 | A1 | 7/2005 | Mersch | |
| 2010/0105532 | A1 * | 4/2010 | Israeli | 482/131 |
| 2010/0248920 | A1 * | 9/2010 | Morales | 482/141 |

* cited by examiner

*Primary Examiner* — Loan Thanh
*Assistant Examiner* — Jennifer M Deichl

(57) ABSTRACT

The pushup exercise device first is rugged and sturdy, for even the heaviest user. The vertical columns and bases may be square for best rigidity. The cross supports may be rectangular for the same reason. Finger holes are optionally provided for best grip, but a user can also place hands atop the upper blocks as chosen. Importantly, the device allows a user to elevate upper body off of the floor for less back and other body part strain, and to slightly decrease the resistance provided in a floor performed pushup. The device is highly portable.

3 Claims, 3 Drawing Sheets

PUSHUP EXERCISE DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Pushups are established as an excellent and almost fully body exercise. But, fully practiced from the floor, pushups can be too difficult for some, and injurious to others. Back strain is just one issue faced with such pushup practices. The present device provides a slightly elevated pushup position, with optional finger gripping, that provides pushup exercise without some of the strain typically associated therewith.

FIELD OF THE INVENTION

The pushup exercise device relates to exercise devices and more especially to a pushup exercise device.

SUMMARY OF THE INVENTION

The general purpose of the pushup exercise device, described subsequently in greater detail, is to provide a pushup exercise device which has many novel features that result in an improved pushup exercise device which is not anticipated, rendered obvious, suggested, or even implied by prior art, either alone or in combination thereof.

To attain this, the pushup exercise device first is rugged and sturdy, for even the heaviest user. The vertical columns and bases may be square for best rigidity. The cross supports may be rectangular for the same reason. Finger holes are optionally provided for best grip, but a user can also place hands atop the upper blocks as chosen. Importantly, the device allows a user to elevate upper body off of the floor for less back and other body part strain, and to slightly decrease the resistance provided in a floor performed pushup. The device is highly portable.

Thus has been broadly outlined the more important features of the improved pushup exercise device so that the detailed description thereof that follows may be better understood and in order that the present contribution to the art may be better appreciated.

An object of the pushup exercise device is to provide for performing pushups.

Another object of the pushup exercise device is to provide for performing pushups without much of the physical strain and risk injury often associated therewith.

A further object of the pushup exercise device is to be highly portable.

An added object of the pushup exercise device is to provide optionally used finger grips And, an object of the pushup exercise device is to be sturdy.

These together with additional objects, features and advantages of the improved pushup exercise device will be readily apparent to those of ordinary skill in the art upon reading the following detailed description of presently preferred, but nonetheless illustrative, embodiments of the improved pushup exercise device when taken in conjunction with the accompanying drawings.

DETAILED DESCRIPTION OF THE DRAWINGS

With reference now to the drawings, and in particular FIGS. 1 through 5 thereof, the principles and concepts of the pushup exercise device generally designated by the reference number 10 will be described.

Figure 2:
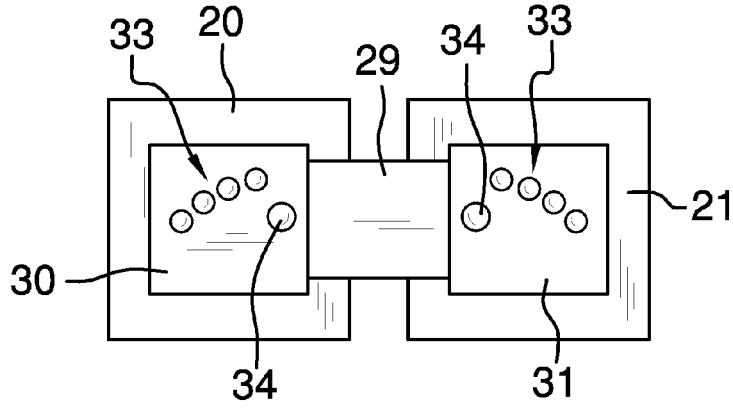
FIG. 2 is a top plan view.

Referring to FIG. 2, the device 10 partially comprises a pair of spaced apart rectangular bases comprising a first base 20 and a second base 21.

Figure 3:
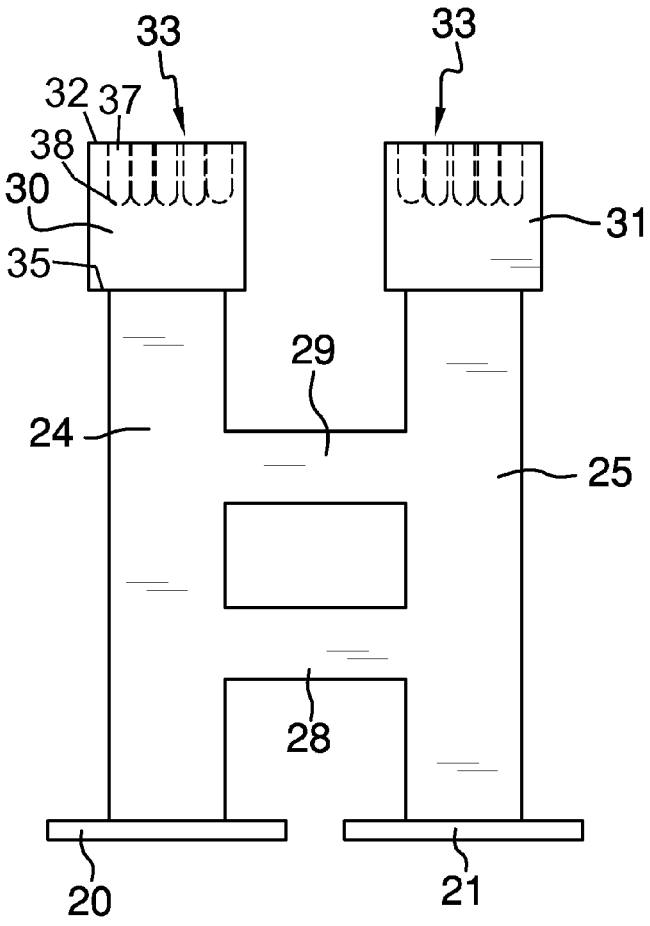
FIG. 3 is a back elevation view.

Referring to FIG. 3, the device 10 further comprises a vertical column vertically disposed on each base. The vertical columns comprise a first vertical column 24 on the first base 20 and a second vertical column 25 on the second base 21. Each of the first and second vertical columns 24, 25 has an inside wall 22, a top end 26, and a bottom end 27 disposed on the respective first base 20 and second base 21.

Figure 1:
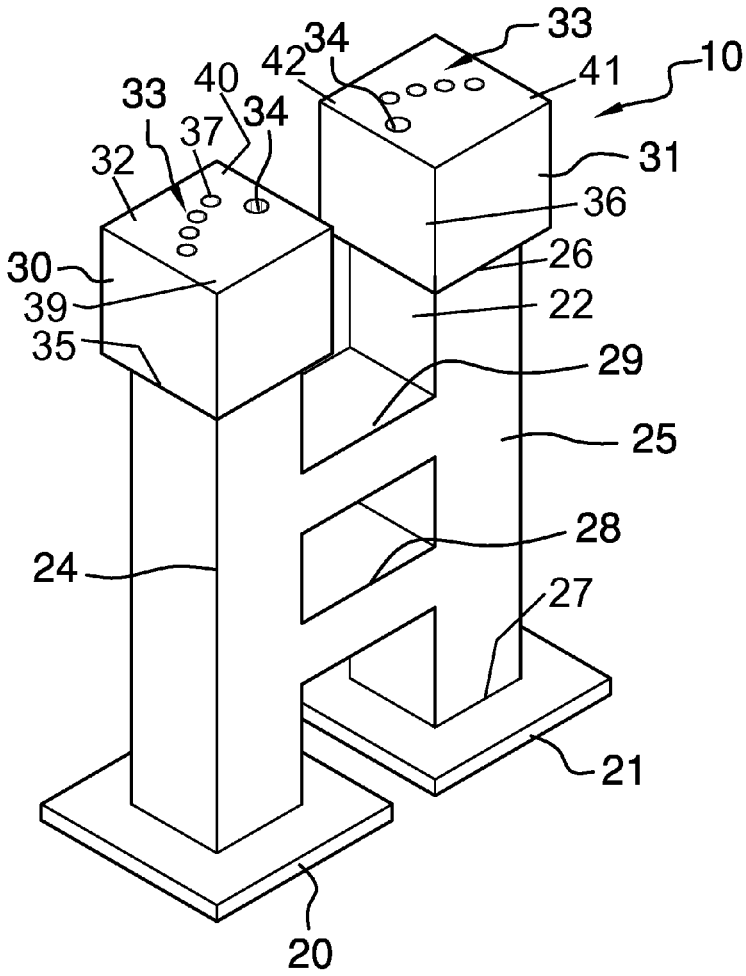
FIG. 1 is a perspective view.

Referring to FIG. 1, an upper block is disposed the top end 26 of each vertical column. The upper blocks comprise the first upper block 30 disposed on the first vertical column 24 and the second upper block 31 disposed on the second vertical column 25. Each upper block 30, 31 has an upper side 32, a lower side 35, and an internal wall 36. The lower side 35 is disposed on the top end 26 of the respective vertical column 24, 25.

Referring to FIG. 2, a quartet of finger holes 33 is disposed within each of the upper blocks. A thumb hole 34 is disposed upwardly within each of the upper blocks. Each of the finger holes 33 and the thumb hole 34 has an open upper end 37 disposed on the upper side 32 of the respective upper block and a closed lower end 38 disposed between the upper side 32 and the lower side 35. The finger holes 33 disposed on the first upper block 30 align diagonally from a front right corner 39 to a rear left corner 40 of the upper side 32 of the first upper block 30 and wherein the finger holes 33 disposed on the second upper block 31 align diagonally from a front left corner 41 to a rear right corner 42 of the upper side 32 of the second upper block 31. The thumb hole 34 of each of the first and second upper blocks 30, 31 is centrally disposed on the upper side 32 proximal the respective internal wall 36 of the first and second upper blocks 30, 31.

Figure 4:
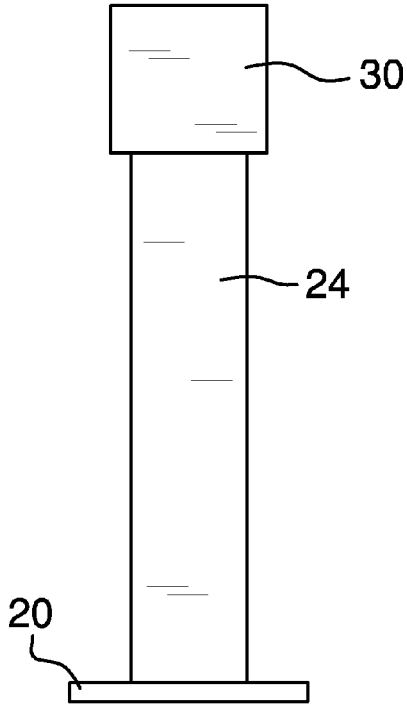
FIG. 4 is a side elevation view.

Referring to FIG. 4, the vertical columns are disposed perpendicularly upward from each base, with the upper block being slightly larger than the vertical columns.

Referring to FIG. 3, the pair of spaced apart cross supports connect the inside walls 22 of the vertical columns. The cross supports comprise a first cross support 28 and a second cross support 29. The first and second cross supports 28, 29 are centrally disposed between the bottom end 27 and the top end 26 of each vertical column.

Figure 5:
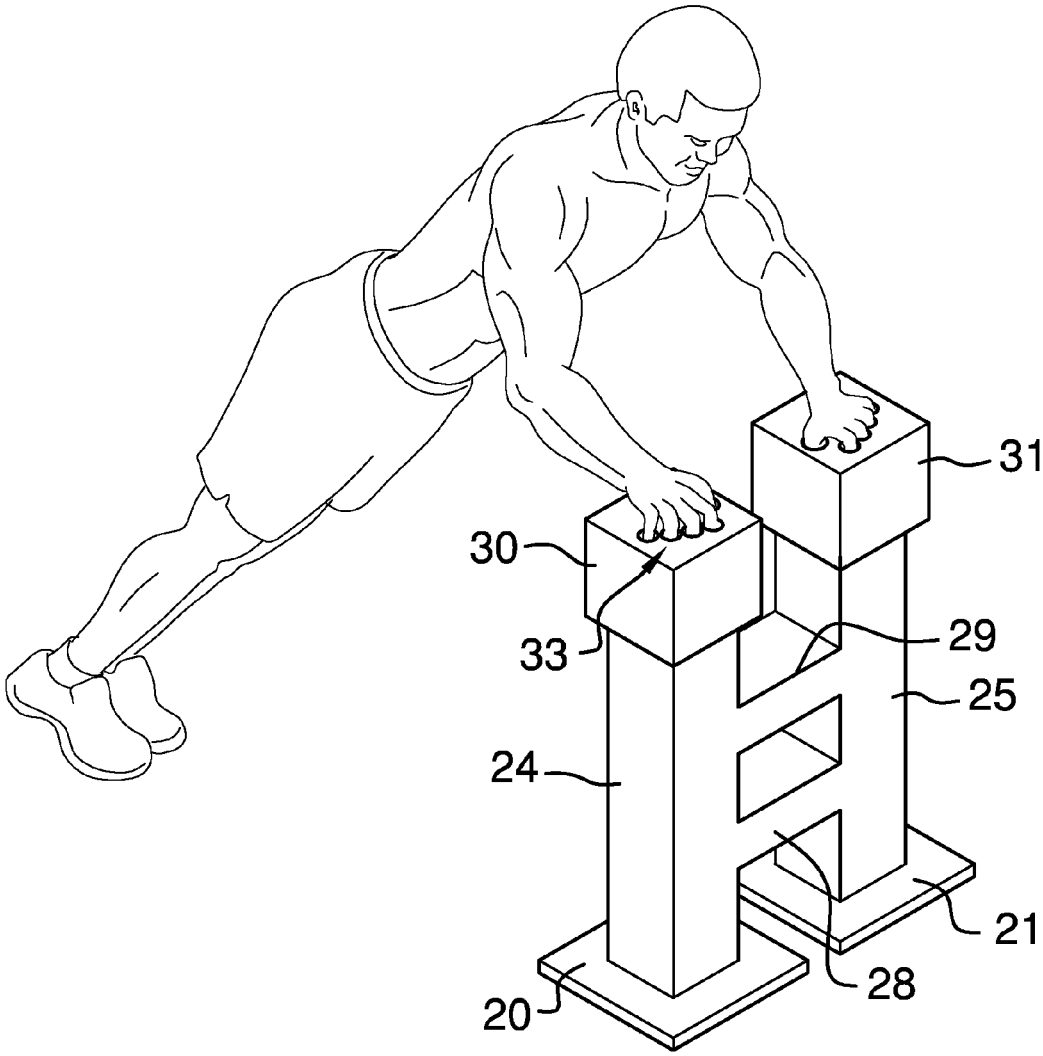
FIG. 5 is a perspective in-use view.

Referring to FIG. 5, the device further comprises square vertical columns, square upper blocks, square bases, and rectangular cross supports. A user optionally uses the finger holes and thumb holes for strengthening grip.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the pushup exercise device may be used.

What is claimed is:

1. A pushup exercise device comprising, in combination:

a pair of spaced apart rectangular bases comprising a first base and a second base;

a vertical column vertically disposed on each base, comprising a first vertical column on the first base and a second vertical column on the second base, each of the first and second vertical columns having an inside wall, a top end, and a bottom end disposed on the respective first base and second base;

an upper block disposed on the top end of each vertical column, comprising a first upper block disposed on the first vertical column and a second upper block disposed on the second vertical column, each upper block having an upper side, a lower side, and an internal wall, the lower side disposed on the top end of the respective first and second vertical column;

a quartet of finger holes disposed within each of the upper blocks;

a thumb hole disposed within each of the upper blocks, each of the finger holes and thumb hole having an open upper end disposed on the upper side of the respective upper block and a closed lower end disposed between the upper side and the lower side;

wherein each of the finger holes is configured to receive a respective one of a user's fingers therein and wherein the thumb hole is configured to receive the user's thumb therein;

a pair of spaced apart cross supports connecting the inside walls of the vertical columns, comprising a first cross support and a second cross support, the first and second cross supports centrally disposed between the bottom end and the top end of each vertical column.

2. The device according to claim 1, wherein:

the vertical columns have a square cross section;

the upper blocks have a square cross section;

the bases have a square cross section; and the cross supports have a rectangular cross section.

3. The device according to claim 1:

wherein the finger holes disposed on the first upper block align diagonally from a front right corner to a rear left corner of the upper side of the first upper block and the finger holes disposed on the second upper block align diagonally from a front left corner to a rear right corner of the upper side of the second upper block; and wherein the thumb hole of each of the first and second upper blocks is centrally disposed on the upper side proximal the respective internal wall of the first and second upper blocks.

* * * * *